US007971281B2

(12) United States Patent
Imai et al.

(10) Patent No.: US 7,971,281 B2
(45) Date of Patent: Jul. 5, 2011

(54) SHOCK ABSORBENT FOR PROTECTIVE PAD AND PROTECTIVE PAD AND PROTECTIVE CLOTHES USING THE SAME

(75) Inventors: Keiko Imai, Fujisawa (JP); Momoyo Terada, Fujisawa (JP); Takeshi Okada, Minato-ku (JP); Akira Niikura, Yokohama (JP)

(73) Assignee: Lighthouse Inc., Kanagawa (JP)

( * ) Notice: Subject to any disclaimer, the term of this patent is extended or adjusted under 35 U.S.C. 154(b) by 630 days.

(21) Appl. No.: 11/991,629

(22) PCT Filed: Jun. 15, 2006

(86) PCT No.: PCT/JP2006/312030

§ 371 (c)(1),
(2), (4) Date: Mar. 7, 2008

(87) PCT Pub. No.: WO2007/039962

PCT Pub. Date: Apr. 12, 2007

(65) Prior Publication Data

US 2009/0056002 A1 Mar. 5, 2009

(30) Foreign Application Priority Data

Oct. 3, 2005 (JP) ..... 2005-008098

(51) Int. Cl.
*A41D 27/26* (2006.01)

(52) U.S. Cl. ..... 2/267

(58) Field of Classification Search ..... 2/16, 22–24, 2/267, 268, 455, 69, 44, 45, DIG. 3, 102, 2/338

See application file for complete search history.

(56) References Cited

U.S. PATENT DOCUMENTS 5,168,576 A * 12/1992 Krent et al. ..... 2/456

FOREIGN PATENT DOCUMENTS

| | | |
|---|---|---|
| CN | 1293015 | 5/2001 |
| JP | 3-46788 | 4/1991 |
| JP | 4-122994 | 11/1992 |
| JP | 3099597 | 4/2004 |

* cited by examiner

*Primary Examiner* — Tejash Patel
(74) *Attorney, Agent, or Firm* — Wenderoth, Lind & Ponack, L.L.P.

(57) ABSTRACT

A shock absorbent device capable of securely protecting physical parts such as the lumbar part and femur part from a shock even imparted intensively to a narrow area of the physical part to be protected. Also, the shock absorbent device or a protective pad and protective clothes using the shock absorbent can be brought into close contact with the physical part to be protected while improving air permeability around the physical part covered with the protective pad or clothes and vary the area contacting with the physical part to be protected. The shock absorbent can be used for a protective pad for protecting physical parts such as the lumbar part and femur part from an external shock exerted thereto and includes a shock dispersing member (2), embedded in a shock absorbing member (1), for absorbing the external shock.

13 Claims, 9 Drawing Sheets

SHOCK ABSORBENT FOR PROTECTIVE PAD AND PROTECTIVE PAD AND PROTECTIVE CLOTHES USING THE SAME

BACKGROUND OF THE INVENTION

1. Technical Field

This invention relates to a shock absorbent and a protective pad and protective clothes using the shock absorbent for protecting physical parts such as the haunch bone of the lumbar part and the thigh bone of the femur part from an external shock imparted thereto in a fall or the like.

2. Description of the Related Art

The shock absorbent for a protective pad of this kind is used for protecting the lumbar part against damage caused by a shock brought about in a fall or by an accident or sports events or other causes. Specifically, an old person or a person with osteoporosis or one who is at risk of the condition is susceptible to an injury of the lumbar part when accidentally falling.

In Published Japanese Translation of PCT International Publication for Patent Application No. 2001-515548, there is disclosed a protective pad for preventing damage to the lumbar part due to falling.

This conventional protective pad is formed integrally of a first layer of high density closed-cell polymer foam, a second layer of low density closed-cell polymer foam and at least one resilient energy absorbing insert embedded within the layers, so as to ensure relatively lightweight properties and acquire high impact resistance.

SUMMARY OF THE INVENTION

It is conceivable that the aforementioned protective pad can absorb a shock or impact when undergoing the shock throughout the whole area of the pad, but the conventional protective pad has disadvantages such that the shock caused to a part of the outer surface of the pad cannot sufficiently be absorbed.

Further, there has been a demand for a protective pad capable of varying an area coming into contact with the lumbar part in accordance with the physical constitution of a user. In order to meet the demand, it is necessary to prepare a plurality of protective pads of different sizes, which is not an economical solution.

Besides, it is desirable to make the protective pad transformable in conformity with the curved surface of the waist in order to improve wearability of the protective pad, but the conventional protective pad cannot fully cope with the demand.

In light of the foregoing situations, the present invention seeks primarily to provide a means capable of securely protecting physical parts such as the lumbar part and femur part from shock even when imparted intensively to a narrow area of the physical part to be protected, and secondarily to provide a shock absorbent and a protective pad and protective clothes using the shock absorbent, which can be brought into close contact with the physical part to be protected while improving air permeability around the physical part covered with the protective pad or clothes and vary the area contacting the physical part to be protected.

A shock absorbent according to the invention is used for a protective pad for protecting physical parts such as the lumbar part and femur part from external shock exerted thereto and is featured by embedding a shock dispersing member in a shock absorbing member for absorbing the external shock.

The means according to the invention can securely protect the physical parts such as the lumbar part and femur part even when the shock is exerted intensively to a narrow area. That is, the external shock imparted to a large area is absorbed by the shock absorbing member, while the external shock imparted intensively to a narrow area is absorbed by the shock dispersing member, so that the physical parts such as the lumbar part and femur part can be securely protected.

The shock absorbent for a protective pad is featured by having air vent holes bored from the front through the back of the shock absorbing member. The invention can also improve air permeability by means of the air vent holes in the shock absorbing member.

The shock absorbent for a protective pad is featured in that the shock absorbing member is formed in a trilaminar structure in which cushioning members having different repulsive coefficients are stuck to both surfaces of a substrate having an accommodating hole analogous to the outline of the shock dispersing member. The invention can better absorb the shock exerted to the physical parts to be protected such as the lumbar part and femur part.

The shock absorbent for a protective pad is also featured in that the shock absorbing member is formed in a trilaminar structure in which cushioning members having different repulsive coefficients are stuck to both surfaces of a substrate having an accommodating hole analogous to the outline of the shock dispersing member, and air vent holes are bored from the front through the back of the shock absorbing member. The invention can better absorb the shock exerted to the physical parts to be protected and improve air permeability.

The shock absorbent for a protective pad is featured in that one of the two cushioning members on the side of the physical part to be protected is formed of plastic foam having air permeability such as highly foamable and low rebound urethane foam. The invention can better absorb the shock exerted to the physical parts to be protected and further improve air permeability.

The shock absorbent for a protective pad is featured in that the shock absorbing member is formed in a trilaminar structure in which cushioning members having different repulsive coefficients are stuck to both surfaces of a substrate having an accommodating hole analogous to the outline of the shock dispersing member, air vent holes are bored from the front through the back of the shock absorbing member, and one of the two cushioning members on the side of the physical part to be protected is formed of plastic foam having air permeability such as highly foamable and low rebound urethane foam. The invention can better absorb the shock exerted to the physical parts to be protected and further improve air permeability.

The shock absorbent for a protective pad is featured in that the shock dispersing member is formed by entwining two metal wires shifted laterally into coils and squashing the coils into a flat shape in whole so as to define contact parts overlapping each other and hollow parts formed by spreading the wire coils.

According to the invention, the shock dispersing member can be flexibly deformed with the shock absorbing member, so that the physical parts such as the lumbar part and femur part can be securely protected. Besides, the shock absorbent of the invention can be brought into close contact with the physical part to be protected.

Further, the weight per unit area of the shock absorbent of the invention can be reduced, consequently to reduce the weight of the protective pad and lessening a physical burden on a user in wearing the protective pad.

The protective pad of the invention is featured in that the shock absorbents are arranged densely so as to tolerate relative inclinations of the shock absorbents.

Also, the protective pad of the invention can be brought into close contact with the physical part to be protected and easily vary the contact area with the physical part by altering the number of the shock absorbents for the protective pad.

The protective pad of the invention is featured in that the shock absorbents are arranged densely so as to tolerate relative inclinations of the shock absorbents.

The protective pad of the invention can be brought into close contact with the physical part to be protected and easily vary the contact area with the physical part by altering the number of the shock absorbents for the protective pad.

The protective pad of the invention is featured in that the shock absorbents are formed of polygonal plates having the same shape and same size and arranged so as to have the side walls being proximately opposite to one another.

The invention facilitates a dense arrangement of the shock absorbents.

The protective pad of the invention is featured in that the shock absorbents are formed of polygonal plates having the same shape and same size and arranged so as to have the side walls being proximately opposite to one another.

The invention facilitates a dense arrangement of the shock absorbents.

The protective pad of the invention is featured by containing the shock absorbent in an outer covering having air permeability and sewing up the outer covering.

The invention can bring the protective pad into close contact with the physical part to be protected and vary the contact area of the protective pad to the physical part to be protected. Moreover, the outer covering containing the shock absorbent is sewed up, thereby to diminish humidity.

The protective pad of the invention is featured by containing the shock absorbent in an outer covering having air permeability and sewing up the outer covering.

The invention can bring the protective pad into close contact with the physical part to be protected and vary the contact area of the protective pad to the physical part to be protected. Moreover, the outer covering containing the shock absorbent is sewed up, thereby to diminish humidity.

Further, the protective clothes according to the invention is featured in that a pad containing bag for containing the protective pad is formed so as to place the protective pad opposite to the physical part to be protected.

The protective pad of the invention can easily be attached in position opposite to the physical part to be protected only by wearing the protective clothes without using any other accessories.

The protective clothes according to the invention is featured in that a pad containing bag for containing the protective pad is formed so as to place the protective pad opposite to the physical part to be protected.

The protective pad of the invention can easily be attached in position opposite to the physical part to be protected only by wearing the protective clothes without using any other accessories.

The protective clothes according to the invention is featured in that a pad containing bag for containing the protective pad is formed so as to place the protective pad opposite to the physical part to be protected.

The protective pad of the invention can easily be attached in position opposite to the physical part to be protected only by wearing the protective clothes without using any other accessories. Also, the pad containing bag can easily be attached in position opposite to the physical part to be protected.

The protective clothes according to the invention is featured in that a pad containing bag for containing the protective pad is formed so as to place the protective pad opposite to the physical part to be protected.

The protective pad of the invention can easily be attached in position opposite to the physical part to be protected only by wearing the protective clothes without using any other accessories. Also, the pad containing bag can easily be attached in position opposite to the physical part to be protected.

EXPLANATION OF REFERENCES MARKS

1 Shock absorbing member
2 Shock dispersing member
4*a*, 3*c* and 5*a* Air vent hole
3*a* Accommodating hole
3 Substrate
4 and 5 Cushioning members
6*a* and 6*b* Metal wire coils
7 Outer covering
11 Pad containing bag
A Shock absorbent for a protective pad
B Protective pad
β Contact parts
α a Hollow parts

DETAILED DESCRIPTION OF THE INVENTION

Figure 1:
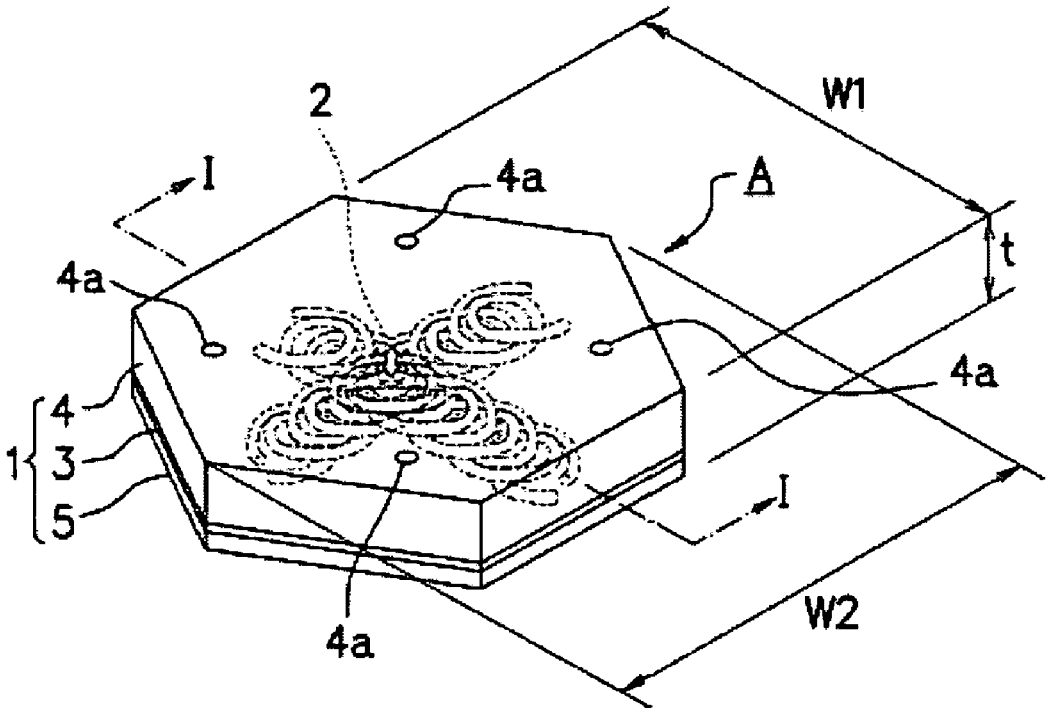
FIG. 1 is a perspective view of a shock absorbent for a protective pad according to one embodiment of the present invention.
Figure 2:
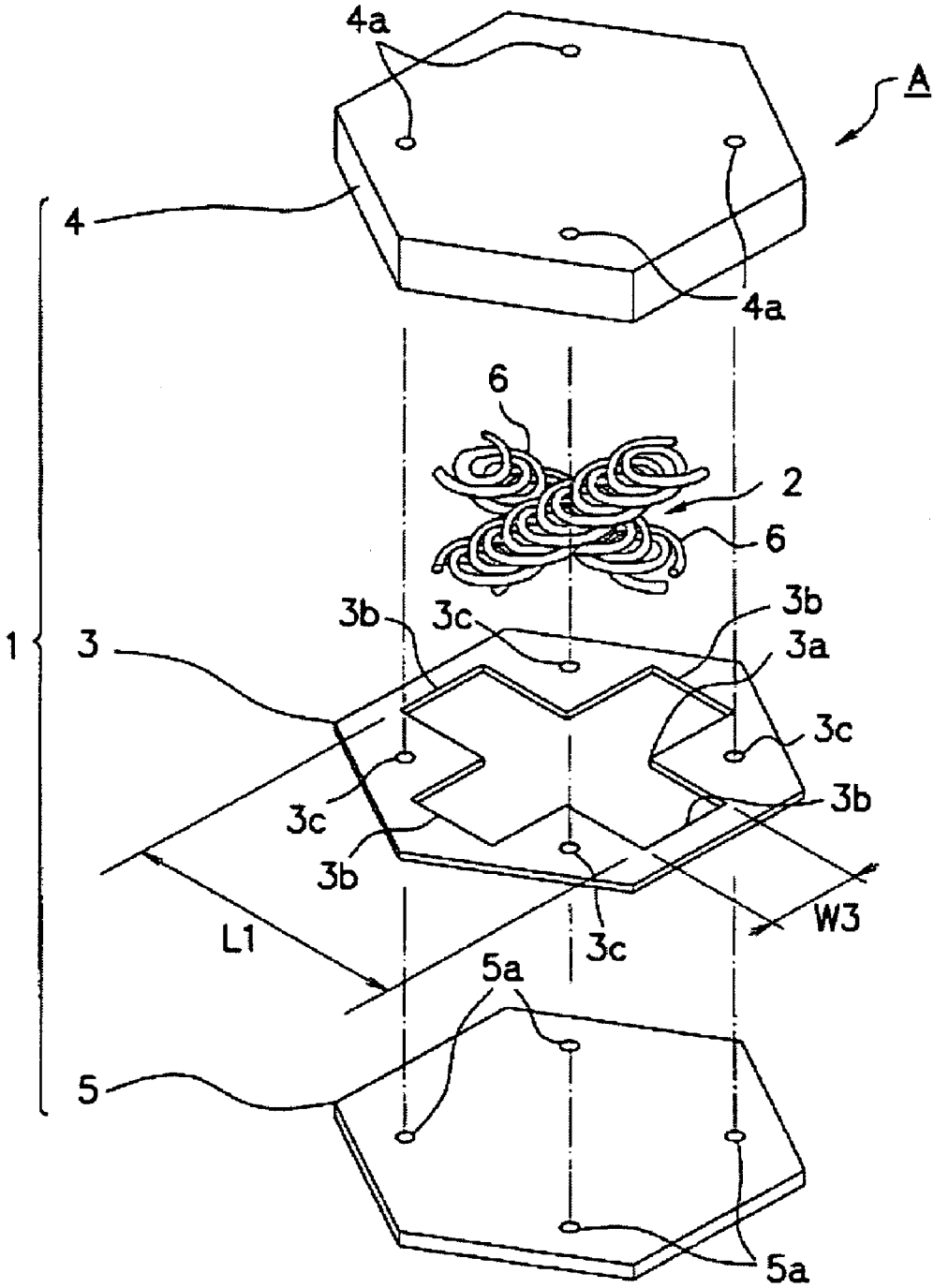
FIG. 2 is an exploded perspective view of the shock absorbent mentioned above.
Figure 3:
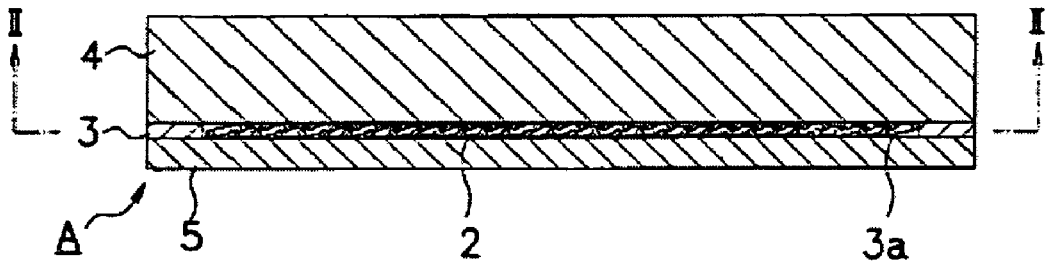
FIG. 3 is a cross sectional view taken along line I-I in FIG. 1.
Figure 4:
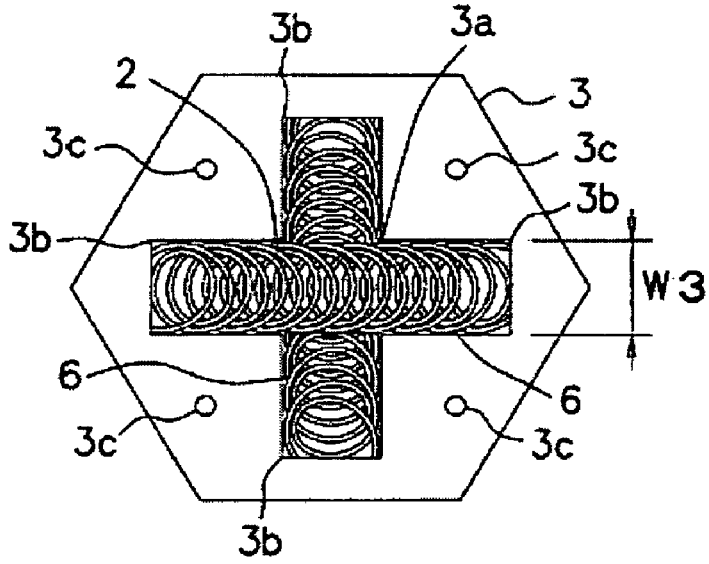
FIG. 4 is a cross sectional view taken along line II-II in FIG. 3.

A preferred embodiment of the present invention will be described hereinafter with reference to the accompanying drawings. FIG. 1 is a perspective view of a shock absorbent for a protective pad according to one embodiment of the present invention, FIG. 2 is an exploded perspective view of the shock absorbent, FIG. 3 is a cross sectional view taken along line I-I in FIG. 1, and FIG. 4 is a cross sectional view taken along line II-II in FIG. 3.

The shock absorbent A for the protective pad (hereinafter simply referred to as "shock absorbent") in one embodiment according to the present invention is applied for the protective pad, which will be described in detail later. The shock absorbent has a shock dispersing member 2 embedded in a shock absorbing member 1 for absorbing the external shock.

The "absorbing of a shock" in this invention means low rebound, which has the property of specifically absorbing the external shock imparted to a large area throughout the outer surface of the shock absorbent A.

The "dispersing of a shock" means a phenomenon in which a shock imparted intensively to a narrow area such as a part of the shock absorbent A is dispersed, that is, the shock power exerted is reduced per unit area.

The shock absorbing member 1 is formed in a trilaminar structure in which cushioning members 4 and 5 having different repulsive coefficients are stuck to both surfaces of a substrate 3 and made of a regular hexagonal plate having a side wall distance W1 of about 45 mm, an apex distance W2 of about 52 mm, and a thickness t of about 11 mm.

The shock absorbing member 1 is not limited to the hexagonal shape as illustrated in the embodiment and may be formed in a shape of convex polygon or concave polygon or any other heteromorphic shapes. Alternatively, it may be shaped in not only a polygon but also a perfect circle or ellipse.

The substrate 3 is made of acrylic foam having a thickness of about 1 mm and has an accommodating hole 3*a* in the center and circular air vent holes 3*c* in four peripheral parts.

The accommodating hole 3*a* is formed by intersecting crosswise slits 3*b* each having a width W of about 10 mm and a length L1 of 36 mm. The accommodating hole 3*a* serves to keep the shock dispersing member 2 in position relative to the substrate, which will be presented in detail later.

The cushioning member 4 is formed of plastic foam such as highly foamable and low rebound urethane foam, which has a thickness of about 7 mm and air permeability. The cushioning member 4 is arranged so as to be opposite to a physical part (not shown) to be protected. The cushioning member has the air vent hole 4*a* positioned opposite to the air vent hole 3*c* in the substrate 3.

The cushioning member 5 is formed of integrally plastic foam such as closed-cell polyethylene foam, which has a thickness of about 3 mm and a circular air vent hole 5*a* positioned opposite to the air vent hole 3*c* in the substrate 3.

Figure 5:
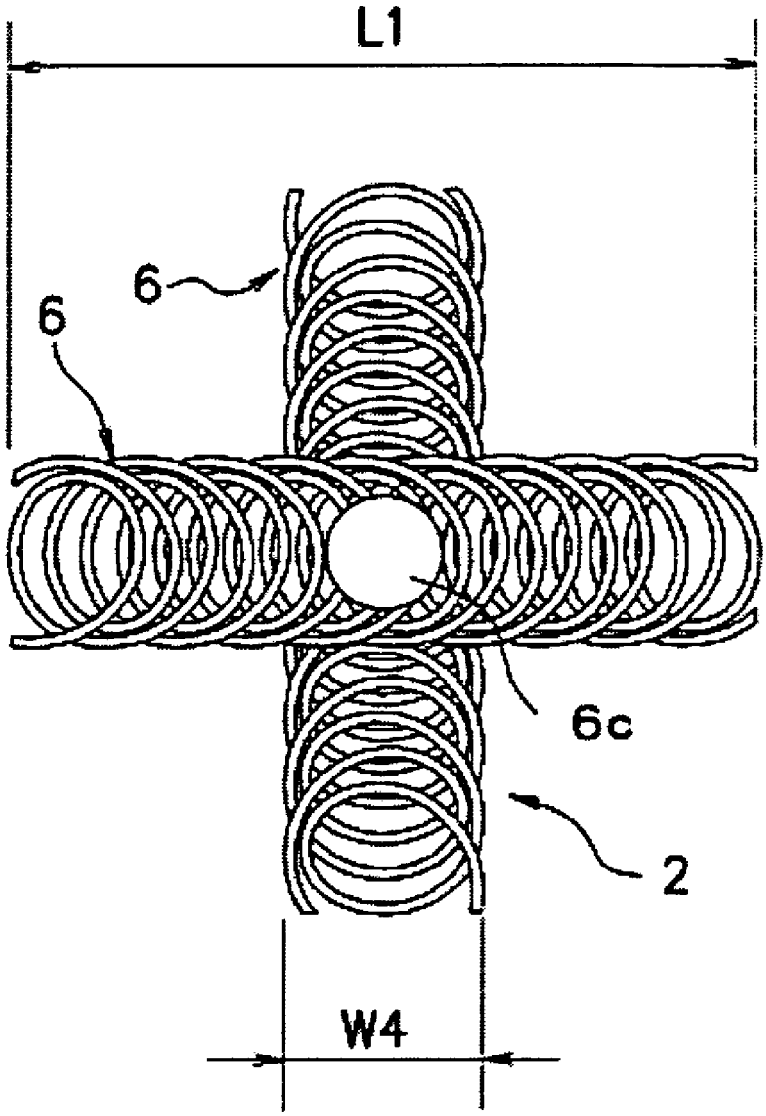
FIG. 5 is an enlarged front view of a shock dispersing member of the invention.

Next, the shock dispersing member 2 will be described. FIG. 5 is an enlarged front view of the shock dispersing member 2, and FIGS. 6(*a*) and 6(*b*) show details of a coil constituting the shock dispersing member 2, in which FIG. 6(*a*) is an enlarged front view thereof, and FIG. 6(*b*) is a side view taken along line in FIG. 6(*a*).

As shown in FIG. 5, the shock dispersing member 2 is formed by combining cruciately metal coils 6 each made of, for example, a SUS 304 wire having a wire diameter of about 0.6 mm, length of about 37 mm and width of about 10. The intersecting points 6*c* of the metal wire coils are connected by, for instance, spot welding.

The coils 6 are formed by entwining in opposite directions two metal wires 6*a* and 6*b* into coils, shifting the coils laterally so as to define contact parts β overlapping each other and hollow parts a formed by spreading the wire coils and squashing the coils into a flat shape in whole.

Figure 6A:
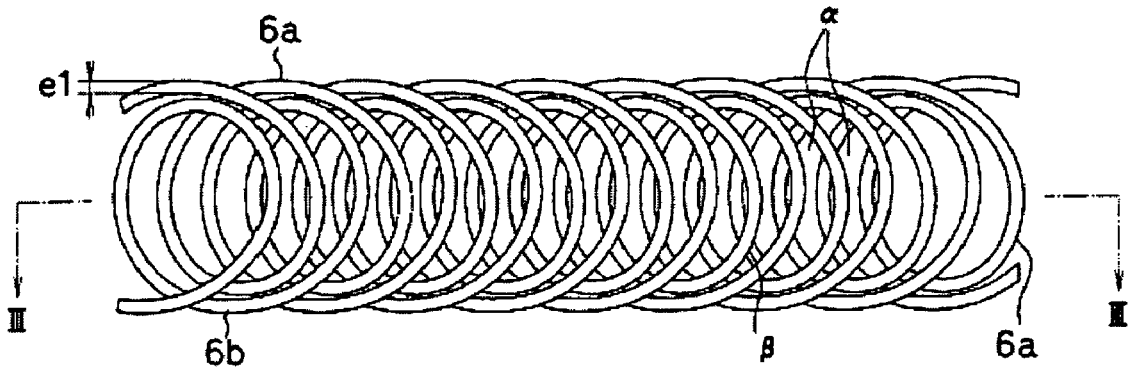
FIGS. 6(*a*) and 6(*b*) are detailed views of a coil constituting the shock dispersing member of the invention, in which FIG. 6(*a*) is an enlarged front view thereof, and FIG. 6(*b*) is a side view along line III-III in FIG. 6(*a*).
Figure 6B:
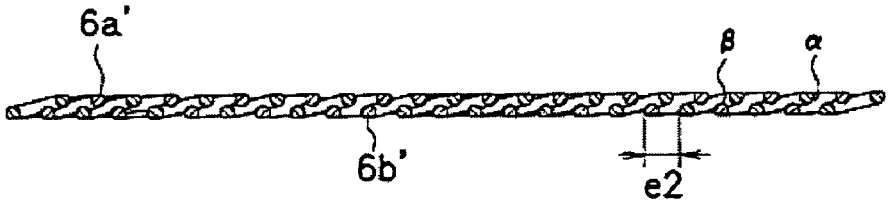

The "flat shape in whole" means flattening of the coils 6 and forming of flattened portions on the metal wires 6*a* and 6*b*. The flattened portions on the metal wires 6*a* and 6*b* are depicted in FIGS. 6(*a*) and 6(*b*). However, only the coil 6 may be made flat without forming the flattened portions on the metal wires 6*a* and 6*b*.

To be specific, the metal wire 6*a* wound sinistrorsely and the metal wire 6*b* wound dextrorsely are intervolved with lateral shift of a crosswise length e1 and a longitudinal length e2.

The shock dispersing member 2 having the closely-spaced metal wires 6*a* and 6*b* wound in opposite directions as described above has high thermal conductivity and high heat dissipation performance. Since the metal wires 6*a* and 6*b* are entwined to increase strength, the shock dispersing member 2 per se can be stabilized in its configuration and prevented from unbending when it is pressure-welded.

Besides, the shock dispersing member is made flat to provide flexibility for the substrate 3 and cushioning members 4 and 5 when being deformed. That is, even when the shock dispersing member is embedded in the shock absorbing member 1, it can be flexibly deformed with the shock absorbing member 1, consequently to provide better wear comfort.

Moreover, the shock absorbent of the invention can be reduced in weight per unit area relative to a flat plate of the same size, consequently to attain a lighter shock absorber. Besides, the hollow parts α formed between the metal wires 6*a* and 6*b* serve as ventilating means for permitting flow of air, thus to accelerate outgoing radiation.

Figure 7:
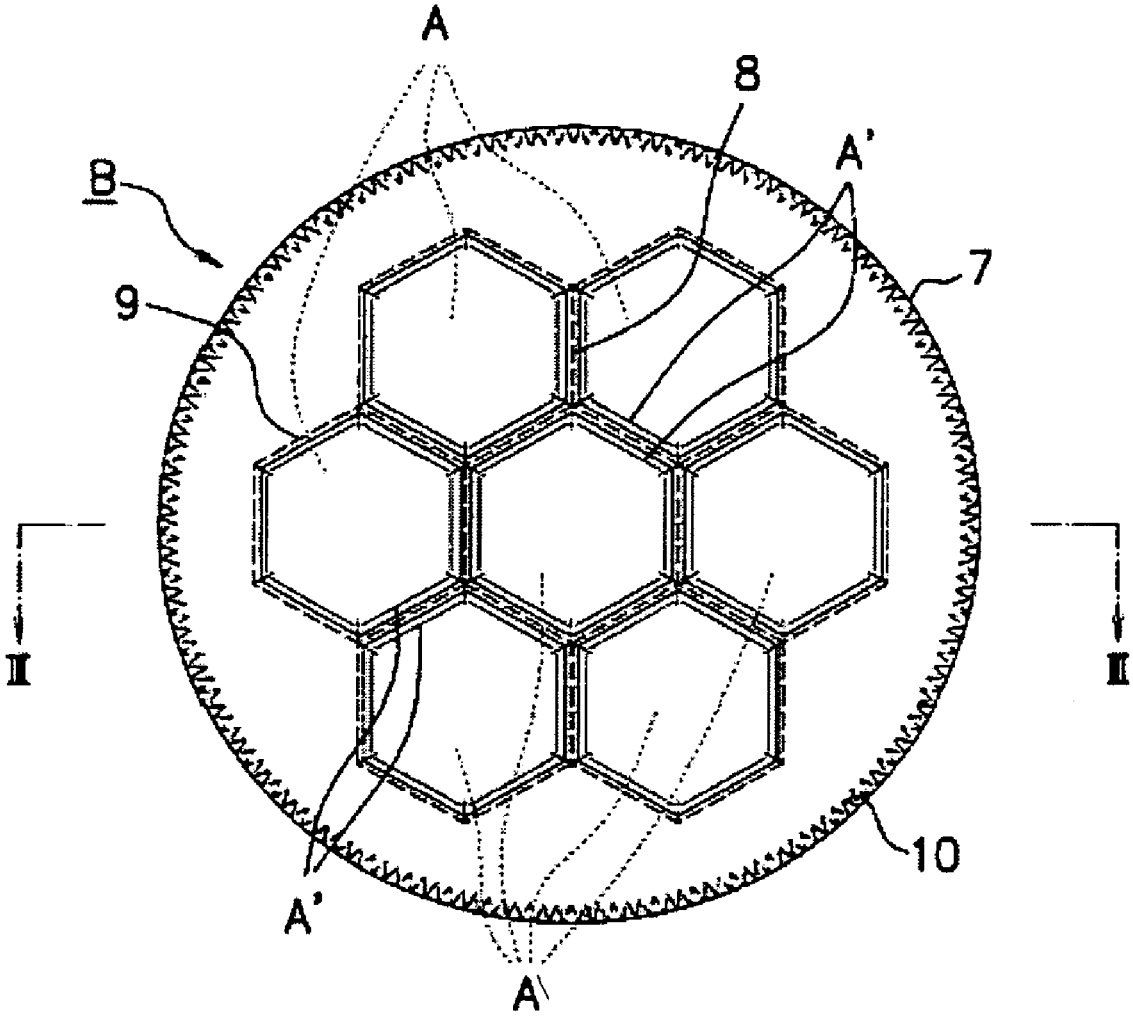
FIG. 7 is a front view of the protective pad of the invention.
Figure 8:
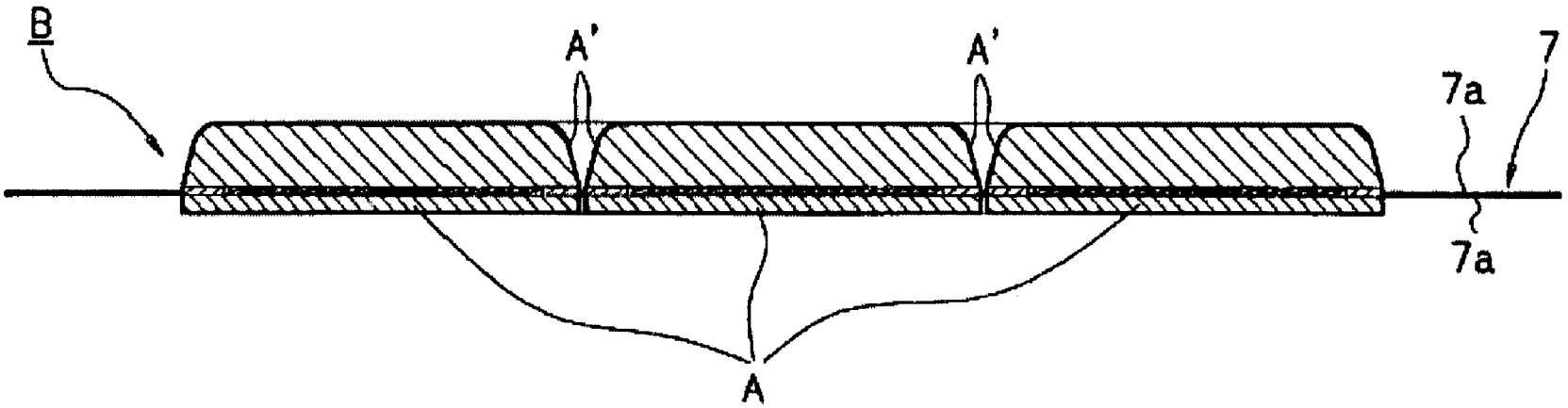
FIG. 8 is a cross sectional view taken along line VI-VI in FIG. 7.

Next, one embodiment of a protective pad using the shock absorbent as described above according to the present invention will be described. FIG. 7 is a front view of the protective pad of the invention, and FIG. 8 is a cross sectional view taken along line VI-VI in FIG. 7.

The protective pad B according to the preferred embodiment of the invention is used for protecting the physical part such as the lumbar part and femur part from an external shock. The protective pad is formed by placing the polygonal shock absorbents of the same shape and size in the state of being proximately opposite to one another so as to assure a prescribed contact area covering the physical part to be protected such as the lumbar part and femur part and contained in an outer covering 7.

The "physical part" is not limited only to the lumbar part and femur part as exemplified above, but has an implication further including the shoulder, arm, head, knee, chest and other body parts.

The protective pad B employs seven shock absorbents A as mentioned above. The shock absorbents A are arranged so as to have the side walls A' being proximately opposite to the side walls A' of the adjacent shock absorbents A. The protective pad thus formed is placed between two air-permeable fabric cloths 7*a* made of cotton or the like and enclosed by sewing the cloths.

The term "proximately opposite" implies not only the state of keeping distance between the side walls A' of the shock absorbents A, but also the state of bringing the shock absorbents into contact with each other through the outer covering 7.

The number of the shock absorbents A is not limited to seven as in this embodiment, but may be adjusted so that the resultant protective pad has a prescribed size so as to adequately cover the physical parts to be protected such as the lumbar part and femur part.

The outer covering 7 is sewed along the peripheral edge between the side walls of the adjacent protective pads B, which is shown by seam lines 8, 9 and 10 in the drawing.

Since the adjacent shock absorbents A keep the prescribed distance between the side walls thereof and the peripheral edges between the side walls of the shock absorbents A are sewed, the shock absorbents A for the protective pad can steadily be secured relative to the outer covering 7 while tolerating relative inclinations of the shock absorbents, which are caused due to relative displacement of the shock absorbents A to the curved surface of the physical part to be protected. As a result, the shock absorbents A can be fitted closely to the physical part to be protected to improve wearability.

Although the protective pads formed in the same polygonal shape of the same size are proximately arranged so as to cover the prescribed area of the physical part in the aforementioned embodiment as one example, the protective pads having different sizes may be densely arranged close to one another.

Figure 9:
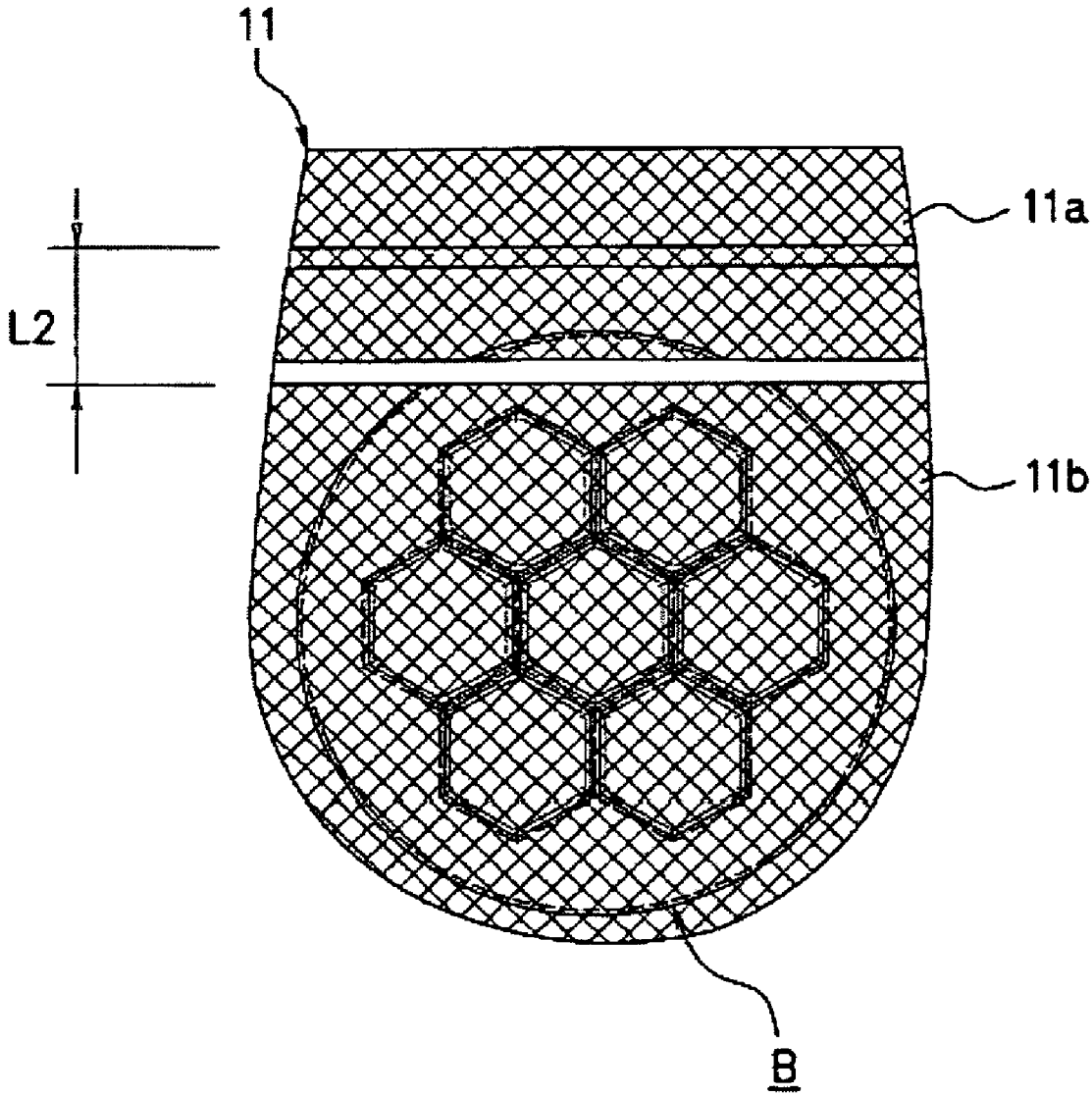
FIG. 9 is a front view of a pad containing bag of the invention.

The protective pad B as described above may be fastened to underclothing with a so-called Magic Tape (registered trademark), but the following type of usage of the protective pad of the invention isrecommended. FIG. 9 is a front view of a pad containing bag of the invention, and FIG. 10 is an explanatory diagram showing a wearing state of protective clothes of the invention.

Figure 10:
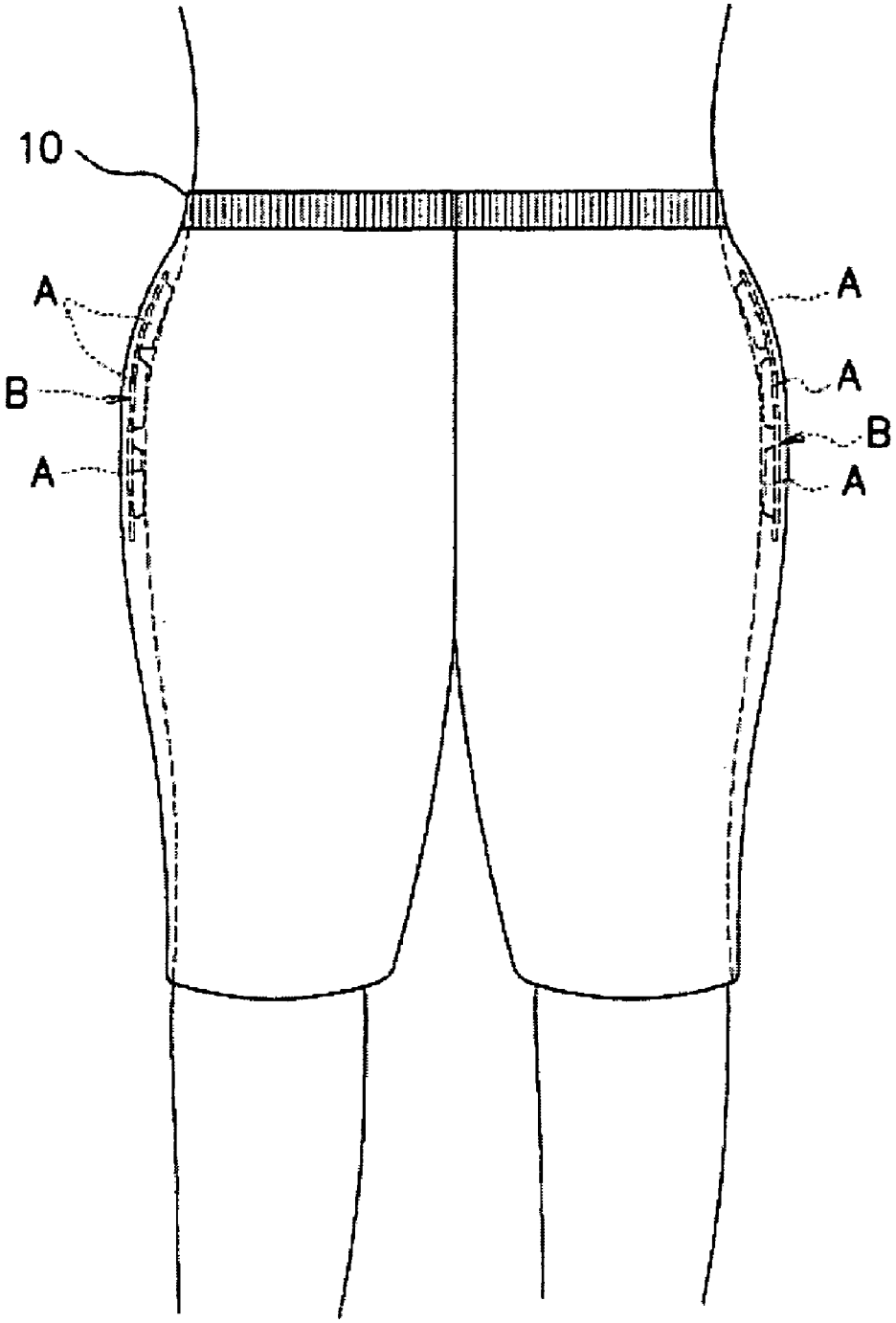
FIG. 10 is an explanatory view showing a state of wearing the protective clothes of the invention.

The protective clothes 10 according to the preferred embodiment of the present invention are provided on their back surfaces to be fitted to the lumbar part (physical part to be protected) with pad containing bags 11 for accommodating the aforementioned protective pads B, as shown in FIG. 10.

As shown in FIG. 9, the pad containing bag 11 has a substantially elongate size enough to accommodate the protective pad B and is formed of mesh fabrics having high air permeability. The pad containing bag is sewed to the back of the underclothing 12 along the peripheral edges of the upper element 11*a* and lower element 11*b* of mesh fabrics, which are superposed by a prescribed width L2. By sewing the peripheral edges of the mesh fabrics to the back of the underwear 12 width in the state of bringing the lower side of the upper element 11*a* into contact with the upper side of the lower element 11*b* by the prescribed seam, an opening for putting the protective pad B into the bag is formed.

As shown in FIG. 10, when wearing the protective clothes formed by containing the protective pads B in the pad containing bags 11, the protective pads B can be suitably placed in position opposite to the lumbar part. The shock absorbents A of the protective pads B opposite to the lumbar part can come in close contact with the lumbar part with relative inclination along the curved surface of the lumbar part in whole, so that the protective clothes can be comfortable to wear and protect steadily the lumbar part.

The present invention is not to be considered limited to what is described above and shown in the drawings, but may be modified as specified below.

Although the foregoing embodiment employs the shock dispersing member formed by cruciately combining and uniting metal coils at the intersecting point thereof by spot welding, the shock dispersing member may be made of a single coil or a coil rounded in a circle.

The shock absorbent and protective pad according to the present invention is applicable to protective clothes for protecting physical parts such as the haunch bone of lumbar part and the thigh bone of femur part from an external shock imparted thereto in a fall or the like.

The invention claimed is:

1. A shock absorbent for a protective pad for protecting physical parts of a user from an external shock exerted thereto, the shock absorbent comprising a shock dispersing member for dispersing the shock embedded in a shock absorbing member for absorbing the external shock, said shock dispersing member being formed by entwining two metal wires shifted laterally into coils and squashing said coils into a flat shape as a whole so as to define contact parts that overlap with each other and hollow parts formed by spreading the wire coils.

2. The shock absorbent claimed in claim 1, wherein said shock absorbing member has air vent holes bored from a front through a back of the shock absorbing member.

3. The shock absorbent claimed in claim 1, wherein said shock absorbing member is formed in a trilaminar structure in which cushioning members having different repulsive coefficients are stuck to both surfaces of a substrate having an accommodating hole analogous to the outline of said shock dispersing member.

4. The shock absorbent claimed in claim 1, wherein said shock absorbing member is formed in a trilaminar structure in which cushioning members having different repulsive coefficients are stuck to both surfaces of a substrate having an accommodating hole analogous to the outline of said shock dispersing member, and said shock absorbing member has air vent holes bored from the front through the back of the shock absorbing member.

5. The shock absorbent claimed in claim 3, wherein one of the two cushioning members on the side of the physical part to be protected is formed of plastic foam having air permeability.

6. The shock absorbent claimed in claim 1, wherein said shock absorbing member is formed in a trilaminar structure in which cushioning members having different repulsive coefficients are stuck to both surfaces of a substrate having an accommodating hole analogous to the outline of said shock dispersing member, said shock absorbing member has air vent holes bored from the front through the back of the shock absorbing member, and one of the two cushioning members on the side of the physical part to be protected is formed of plastic foam having air permeability.

7. A protective pad comprising a plurality of said shock absorbents defined in claim 1, said shock absorbents being arranged densely so as to tolerate relative inclinations of the shock absorbents.

8. A protective pad comprising a plurality of said shock absorbents defined claim 1, wherein said shock absorbents are formed of polygonal plates having the same shape and same size and arranged so as to have side walls that are proximately opposite to one another.

9. The protective pad claimed in claim 7, wherein said shock absorbents are contained in an outer covering having air permeability, said outer covering being sewn to contain said shock absorbents therein.

10. Protective clothes including a pad containing bag for containing said protective pad defined in claim 7, said pad containing bag being formed so as to place said protective pad opposite to the physical part to be protected.

11. Protective clothes including a pad containing bag for containing said protective pad defined in claim 9, said pad containing bag being formed so as to place said protective pad opposite to the physical part to be protected.

12. A shock absorbent for a protective pad for protecting a lumbar part and a femur part of a user from an external shock exerted thereto, the shock absorbent comprising a shock dispersing member for dispersing the shock embedded in a shock absorbing member for absorbing the external shock, said shock dispersing member being formed by entwining two metal wires shifted laterally into coils and squashing said coils into a flat shape as a whole so as to define contact parts that overlap with each other and hollow parts formed by spreading the coils of the shock dispersing member.

13. The shock absorbent claimed in claim 3, wherein one of the two cushioning members on the side of the physical part to be protected is formed of a highly foamable and low rebound urethane foam.

* * * * *